US007649811B2

(12) United States Patent
Courvoisier et al.

(10) Patent No.: US 7,649,811 B2
(45) Date of Patent: Jan. 19, 2010

(54) TIMEPIECE WITH MOON PHASE INDICATOR

(75) Inventors: Raphaël Courvoisier, Peseux (CH); Chrystel Gressly, Courfaivre (CH); Christian Bracher, Albligen (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 5 days.

(21) Appl. No.: 12/164,809

(22) Filed: Jun. 30, 2008

(65) Prior Publication Data

US 2009/0003137 A1 Jan. 1, 2009

(30) Foreign Application Priority Data

Jun. 28, 2007 (EP) ..... 07111341

(51) Int. Cl.
*G04B 19/26* (2006.01)

(52) U.S. Cl. ..... 368/18

(58) Field of Classification Search ..... 368/14, 368/15–20; 968/210
See application file for complete search history.

(56) References Cited

U.S. PATENT DOCUMENTS 4,548,512 A * 10/1985 Erard ..... 368/15
4,684,260 A 8/1987 Jaeckle
4,853,908 A * 8/1989 Bourquin et al. ..... 368/19
4,993,002 A * 2/1991 Kerr ..... 368/19
5,155,710 A * 10/1992 Roop ..... 368/18
5,475,655 A * 12/1995 Kerr ..... 368/19
2004/0156269 A1 * 8/2004 Plange et al. ..... 368/17

FOREIGN PATENT DOCUMENTS

FR 2 862 143 5/2005

OTHER PUBLICATIONS

European Search Report issued in corresponding application No. EP 07 11 1341, completed Apr. 21, 2008.

* cited by examiner

*Primary Examiner*—Vit W Miska
(74) *Attorney, Agent, or Firm*—Griffin & Szipl, P.C.

(57) ABSTRACT

The invention concerns a timepiece including a dial (12) fitted with an aperture (16) behind which is mounted a moon phase disc (18) driven in rotation by a moon phase train (24). According to the invention said disc (18) is mounted so as to move in rotation about a fixed sun pinion (36). Moreover, two planetary wheels (44*a*, 44*b*), secured in rotation to representations of the moon (19*a*, 19*b*), are mounted so as to move in rotation on the disc (18), at least indirectly meshed with the sun pinion (36), so as to form a planetary train with the sun pinion (36).

16 Claims, 4 Drawing Sheets

TIMEPIECE WITH MOON PHASE INDICATOR

This application claims priority from European Patent Application No. 07111341.9 filed Jun. 28, 2007, the entire disclosure of which is incorporated herein by reference.

FIELD OF THE INVENTION

The invention relates to the field of horology. More specifically it concerns a timepiece such as a watch provided with a moon phase indicator. Such timepieces are known to the persons skilled in the art.

BACKGROUND OF THE INVENTION

They generally include a moon phase mechanism, formed of a gear train driven by an hour wheel and of a disc to which two representations of the moon are affixed. The disc is visible behind an aperture in the general shape of a semi circle, the diameter side of which includes two convex portions arranged such that the moon appears to be ascending, full, then descending progressively during its path through the aperture. This conventional representation of the phases of the moon does not permit any fun or surprising effects, although such effects are greatly sought after in horology. Moreover, this representation is not true to reality, since the incline of the moon relative to the 12 o'clock-6 o'clock axis of the watch, varies depending upon the position of the moon in the aperture. When a face is drawn on the moon, as is commonly the case, at first the face is perpendicular to the 12 o'clock-6 o'clock axis, then parallel, then perpendicular again. The effect obtained is neither realistic nor attractive.

The present invention overcomes these drawbacks by proposing a timepiece fitted with a moon phase indication wherein the representations of the moon are mobile in rotation on the moon phase disc.

SUMMARY OF THE INVENTION

More specifically, the invention concerns a timepiece comprising a dial with an aperture behind which there is mounted a moon phase disc driven in rotation by a moon phase gear train. According to the invention, the disc is mounted to be mobile in rotation about a fixed sun pinion, and two planetary wheels, each of which is rigidly locked with a representation of the moon, are rotatably mounted on said disc, engaging at least indirectly with the solar pinion, so as to form a planetary gearing with the sun pinion.

Owing to the features of the invention, the representations of the moon are mobile in rotation with respect to the moon phase disc. This feature provides numerous attractive and surprising effects.

In a particular embodiment, two intermediate wheels are mounted on the moon phase disc, inserted between the planetary wheels and the sun pinion.

This advantageous feature enables the representations of the moon to rotate in a direction opposite to that of the moon phase disc.

In a particularly advantageous embodiment, the planetary wheels are fitted with a toothing and the sun pinion is fitted with a toothing, the ratio of the number of teeth between the toothings of the planetary wheels and the toothing of the sun pinion being equal to 1.

This feature enables the representations of the moon to rotate at the same angular velocity as the moon phase disc and in the opposite direction. As a result, the representations of the moon appear with a fixed incline relative to the 12 o'clock-6 o'clock axis of the timepiece, when they pass through the aperture.

Other features and advantages of the present invention will appear more clearly from the following detailed description of an example embodiment of a timepiece fitted with a moon phase indication according to the invention, this example being given purely by way of non-limiting illustration, with reference to the annexed drawings.

DETAILED DESCRIPTION OF ONE EMBODIMENT OF THE INVENTION

Figure 1:
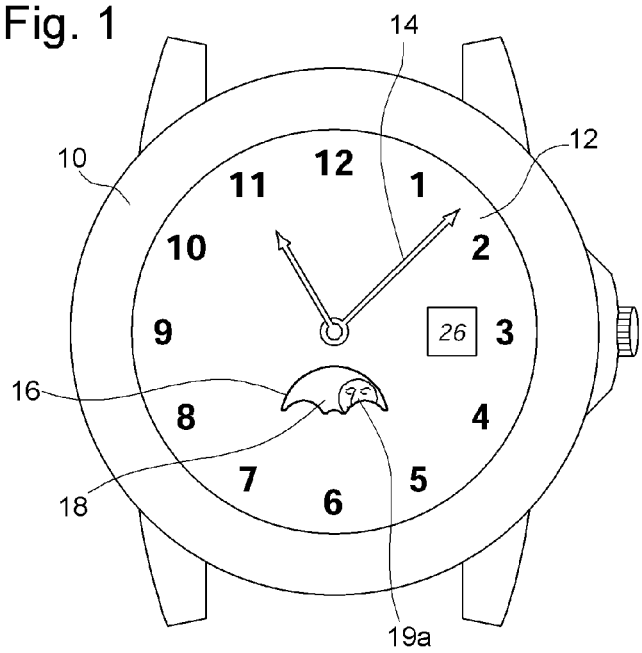
FIG. 1 is an overall view of the timepiece according to the invention.

The timepiece illustrated in FIG. 1 includes, in a conventional manner, a case 10 defining a volume containing a mechanical or electromechanical timepiece, not visible in FIG. 1. The timepiece also includes a dial 12 to which hour symbols and display members 14, such as hands are affixed, cooperating with dial 12 in order to provide a time indication.

The timepiece is further provided with a moon phase indication formed by a moon aperture 16, made in dial 12, and a moon phase disc 18, mounted so as to move in rotation behind aperture 16. The moon phase disc 18 is conventionally fitted with two representations of the moon 19*a* and 19*b* arranged on the same diameter, on either side of the centre, so as to appear in turn through aperture 16.

Figure 2:
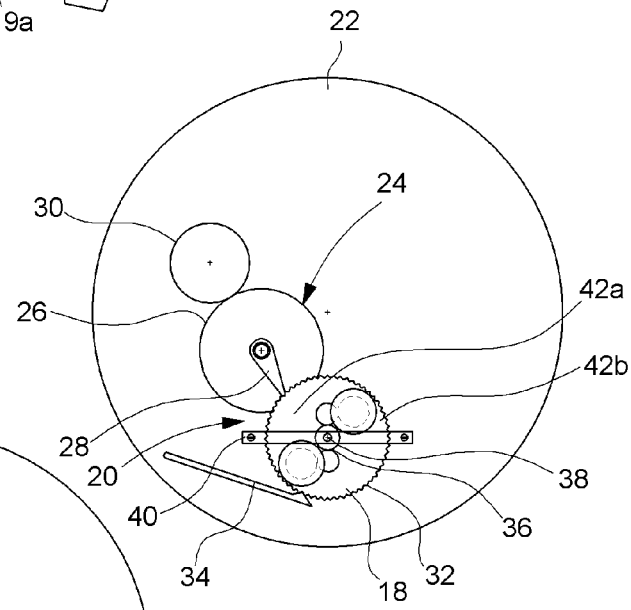
FIGS. 2 and 3 are top views of two variants of a moon phase mechanism integrated into the timepiece according to the invention.
Figure 3:
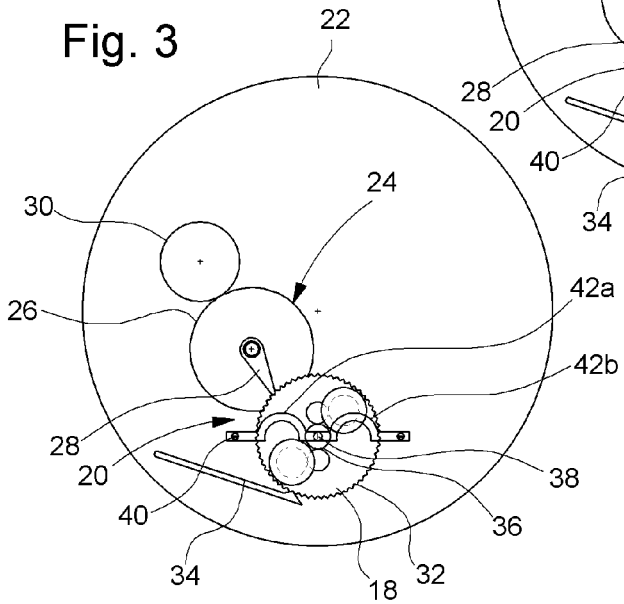

The moon phase disc 18 is the visible part of a moon phase mechanism 20 illustrated in FIGS. 2 and 3. Moon phase mechanism 20 is mounted on the dial side of a plate 22. It includes, in a conventional manner, a moon phase gear train 24 formed of a drive wheel 26 fitted with a finger 28. Moon phase train 24 is driven in rotation at a rate of one revolution per day, by an hour wheel 30, which draws its drive force from the movement. Finger 28 cooperates with moon phase disc 18, so as to drive it step by step, at a rate of one step per day. Moon phase disc 18 is fitted with a star toothing 32, comprising 59 teeth, for this purpose. Disc 18 is also positioned by a jumper spring 34. This is a conventional arrangement and it allows moon phase disc 18 to complete one revolution in 59 days, which equates to two lunations of 29.5 days.

In a variant of this embodiment, inserted between drive wheel 26 and moon phase disc 18, moon phase train 24 includes a star wheel 7 bearing a pinion with 16 teeth, driven by finger 28, and an intermediate wheel with 16 teeth cooperating with moon phase disc 18 and driven by the pinion with 16 teeth. Disc 18 is thus fitted with 135 teeth and completes one revolution in 59.0625 days, which equates to two lunations of 29.53125 days, very close to the true value. This embodiment is known to those skilled in the art and will not be described in more detail here.

According to the invention, moon phase disc 18 is mounted so as to move in rotation about a sun pinion 36 fixedly mounted on plate 22. For this purpose, sun pinion 36 is driven into an arbour 38 rigidly mounted on plate 22 via a lunation bridge 40. Lunation bridge 40 is formed of a straight bar, as illustrated in FIG. 2, secured via both ends to plate 22. In a variant, the bar includes two convex portions 42*a* and 42*b*, as illustrated in FIG. 3. The advantage of this arrangement will be explained below. In another embodiment, arbour 38 is rigidly mounted in plate 22 without lunation bar 40.

Figure 4:
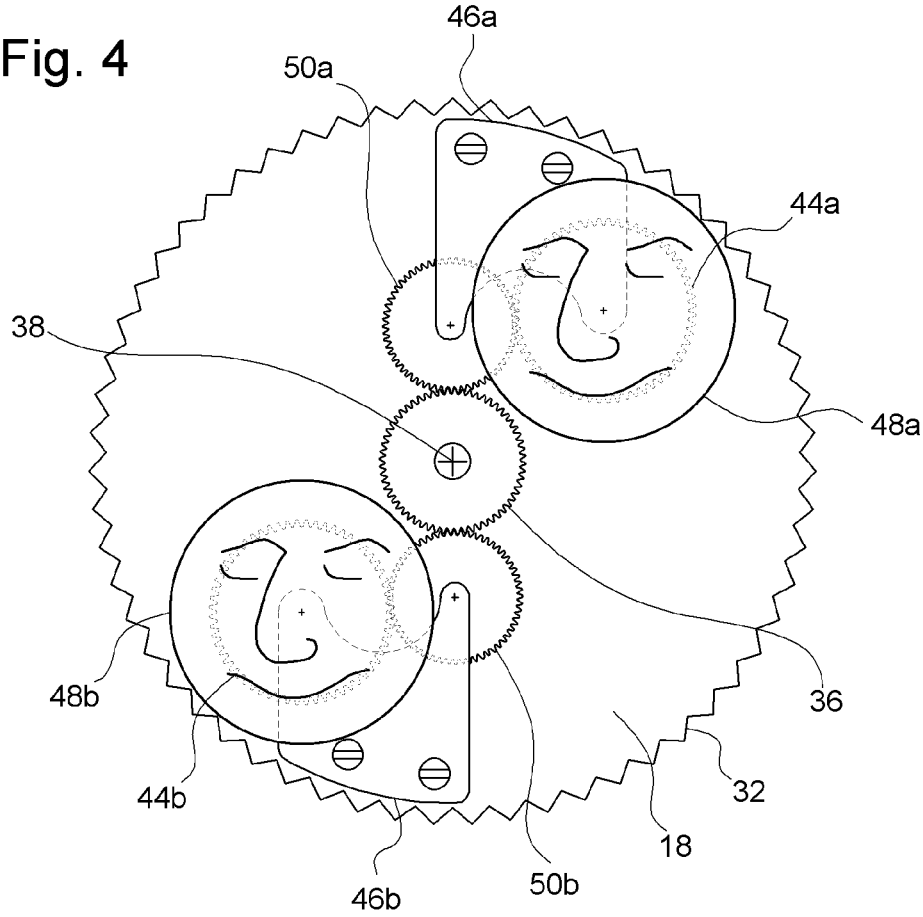
FIG. 4 is a top view of a moon phase disc belonging to the preceding mechanism.

Moon phase disc 18 is shown in more detail in FIG. 4. Two planetary wheels 44*a* and 44*b* are mounted so as to move in rotation on disc 18, via two planetary bridges 46*a* and 46*b*, respectively, or, in a variant, without any bridges. Planetary wheels 44*a* and 44*b* are secured in rotation to two discs 48*a* and 48*b* to which symbolic or realistic images of the moon are affixed. Discs 48*a* and 48*b* form representations of the moon 19*a* and 19*b* visible through aperture 16.

Planetary wheels 44*a* and 44*b* mesh with two intermediate wheels 50*a* and 50*b* mounted so as to move in rotation on disc 18 via planetary bridges 46*a* and 46*b*, or, in a variant, without any bridges. Intermediate wheels 50*a* and 50*b* themselves mesh with sun pinion 36, such that the assembly of wheels 44—intermediate wheels 50—sun pinion 36 form a planetary train. Advantageously, the toothings of sun pinion 36 and planetary wheels 44*a*, 44*b* include an identical number of teeth, whereas intermediate wheels 50*a*, 50*b* can be provided with any number of teeth. In a variant of this embodiment, planetary wheels 44*a* and 44*b* mesh directly with sun pinion 36.

Figure 5:
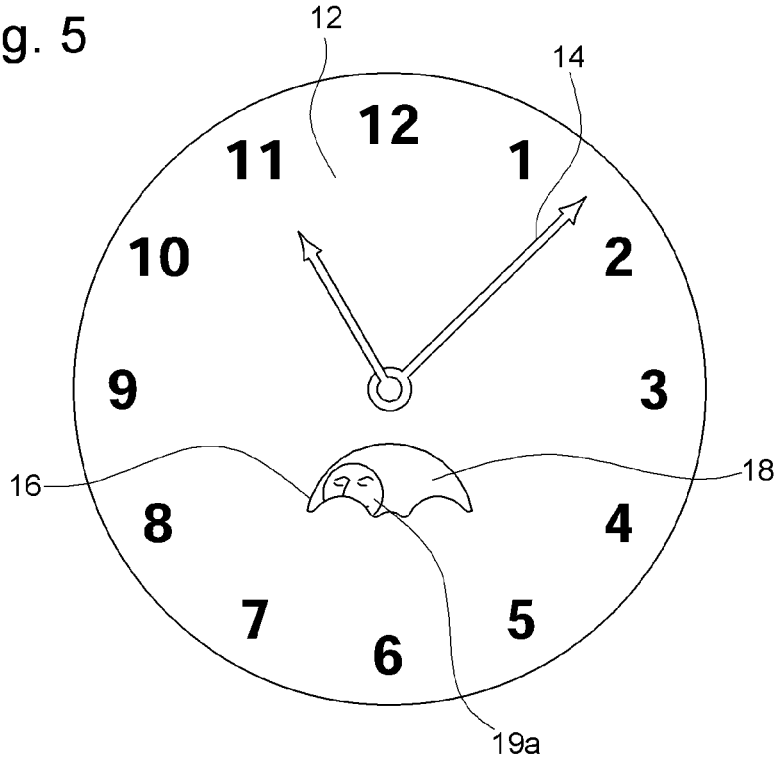
FIGS. 5 to 7 illustrate the operation of the moon phase mechanism integrated into the timepiece according to the invention.
Figure 6:
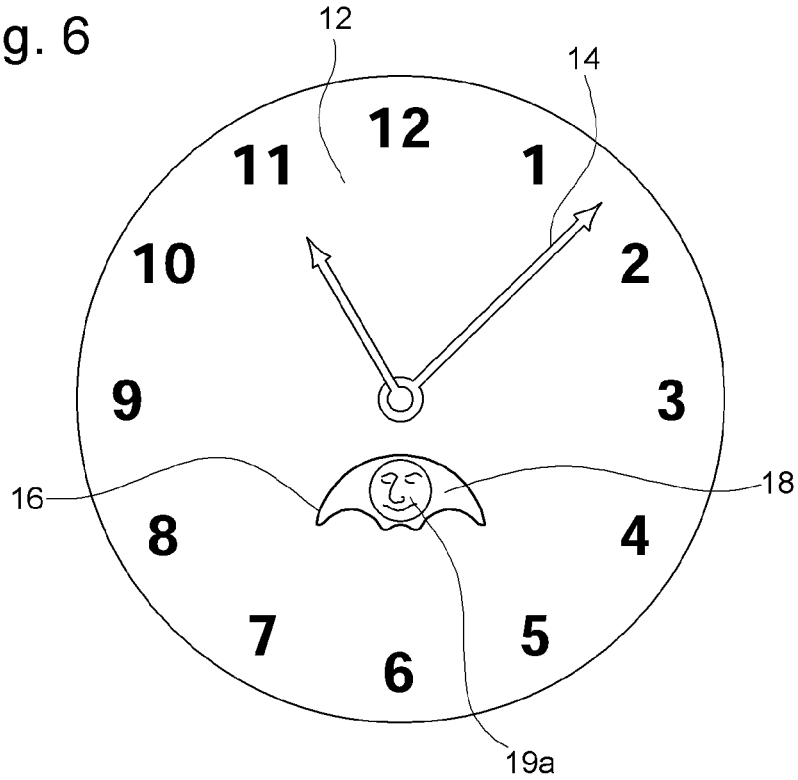
Figure 7:
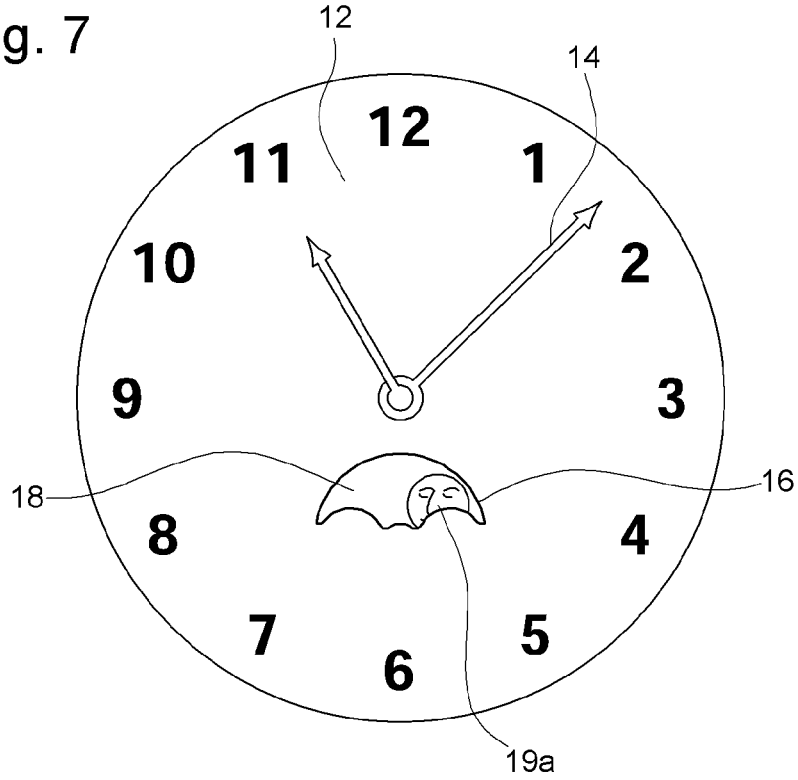

The operation of the timepiece thus described is illustrated in FIGS. 5 to 7. When the moon phase train 24 drives moon phase disc 18 in rotation clockwise, intermediate wheels 50*a*, 50*b*, which rotate about the fixed sun pinion 36, are driven in rotation clockwise about their arbour, by sun pinion 36. In turn, they drive planetary wheels 44*a*, 44*b* in rotation anti-clockwise. When the ratio of the number of teeth of the toothings of sun pinion 36 and planetary wheels 44*a*, 44*b* is equal to one, planetary wheels 44*a* and 44*b* complete one revolution about their arbour in the same time that disc 18 completes one revolution about its arbour. The incline of planetary wheels 44*a* and 44*b* relative to the 12 o'clock-6 o'clock axis of the timepiece thus remains fixed when disc 18 rotates. Accordingly, the representations of the moon 19*a* and 19*b* appear with a fixed incline during their entire travel through aperture 16. This effect is visible in FIGS. 5 to 7 which illustrate three angular positions of disc 18, and the fixed incline of moon representations 19*a* and 19*b* in these three positions. This operation thus gives rise to a more realistic and a particularly attractive representation of the phases of the moon.

It will be noted that in the other embodiments described, planetary wheels 44*a* and 44*b* have the possibility of rotating more or less quickly than disc 18, depending upon the ratio of the number of teeth of the toothings of sun pinion 36 and planetary wheels 44*a*, 44*b*. They may also rotate in the same direction as disc 18, or in the opposite direction, depending upon whether or not intermediate wheels 50*a*, 50*b* are inserted between planetary wheels 44*a*, 44*b* and sun pinion 36. These different variants allow all sorts of interesting fun effects.

Figure 8:
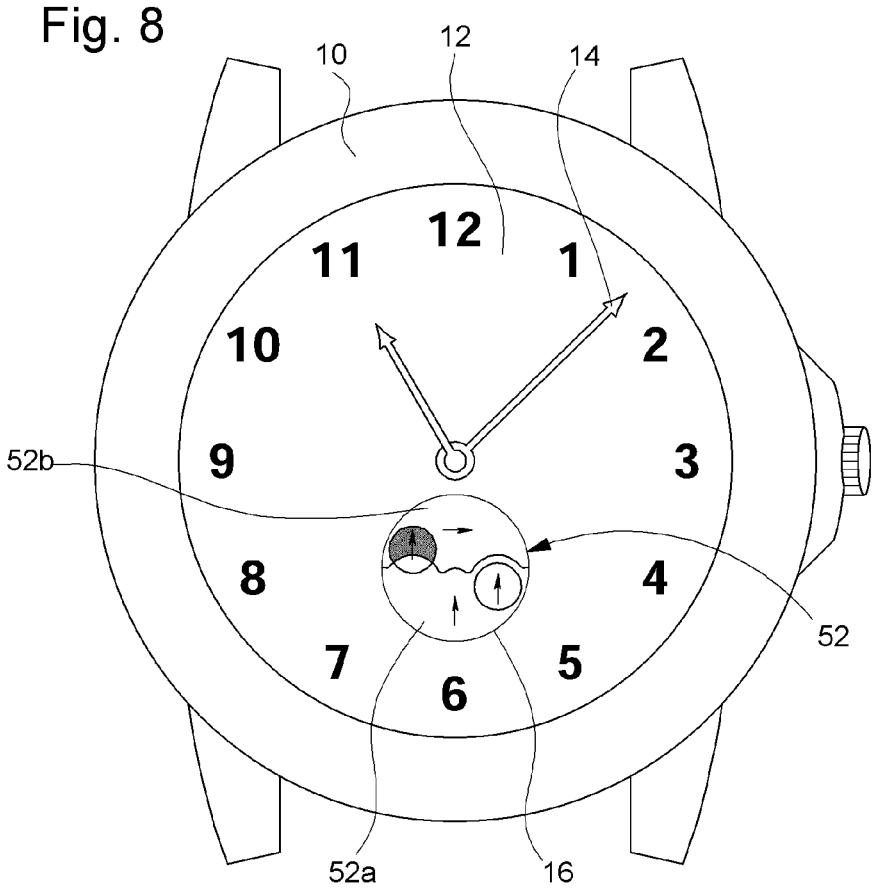
FIG. 8 shows a particularly advantageous variant of a timepiece according to the invention.

Referring now to FIG. 8, this shows a particular embodiment of a timepiece according to the invention. In this embodiment, the ratio of the number of teeth of the toothings of planetary wheels 44*a* and 44*b* and of sun pinion 36 is equal to 1. Moreover, two intermediate wheels 50*a*, 50*b* are inserted between planetary wheels 44*a* and 44*b* respectively and sun pinion 36. Disc 18 is mounted on plate 22 without lunation bridge 40.

Moreover, discs 48*a* and 48*b* are formed of two polarizer-glass plates whose polarization relative to the 12 o'clock-6 o'clock axis of the timepiece is identical and defined. For example, as illustrated in FIG. 8, one may choose to orient the polarizer-glass plates parallel to the 12 o'clock-6 o'clock axis.

Aperture 16 is circular. It is sealed by a polarizer-glass plates 52 formed of a bottom half 52*a* and a top half 52*b*, which are complementary and placed side by side The diameter of bottom half 52*a* has two convex portions, such that top half 52*b* takes the conventional form of a moon aperture. Bottom half 52*a* is polarized parallel to the 12 o'clock-6 o'clock axis, whereas top half 52*b* is polarized perpendicular to that axis.

When disc 18 is being driven in rotation, discs 48*a* and 48*b* pass behind the two aperture halves 52*a* and 52*b*. Since discs 48*a* and 48*b* have a fixed incline relative to the 12 o'clock-6 o'clock axis, the polarization of these discs remains parallel to that axis for the entire duration of their travel through aperture 16. The superposition of two glass plates of parallel polarization appears transparent, whereas the superposition of two glass plates of perpendicular polarization appears opaque. As a result, when the discs 48*a* and 48*b* pass behind top half 52*b* of aperture 16, they are visible and appear to be opaque, whereas when they pass behind bottom half 52*a*, they appear to be transparent, thus barely visible. Their travel therefore includes an active part, when they are visible, and a passive part, when they are transparent.

Figure 9:
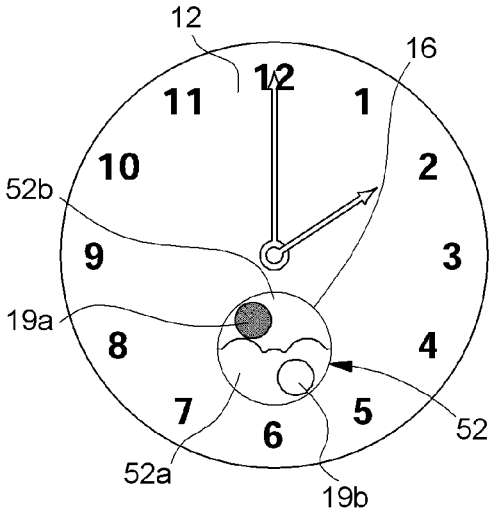
FIGS. 9 and 10 illustrate the operation of this variant of a timepiece according to the invention.
Figure 10:
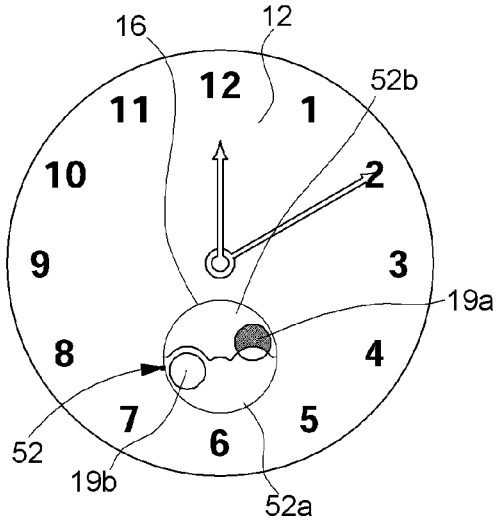

The visual effect obtained for the moon phase display is particularly attractive. It is illustrated in FIGS. 9 and 10. The whole of disc 18, and the parts mounted thereon, is visible through aperture 16. Only discs 48*a* and 48*b* appear alternately to be transparent, in half 52*a* of aperture 16 where they provide no moon phase information, then opaque in half 52*b* where they indicate the moon phase.

It will be noted that in this embodiment, disc 18 can be mounted on plate 22 via a lunation bridge 40. In such case, a lunation bridge 40 comprising two convex portions 42*a* and 42*b* will preferably be used, as illustrated in FIG. 3.

A timepiece fitted with an improved moon phase indication has thus been described. It goes without saying that the present invention is not limited to the embodiments that have just been described and that various simple alterations and variants could be envisaged by those skilled in the art, without departing from the scope of the present invention as defined by the annexed claims.

It will be noted, in particular, that in the embodiments described, planetary wheels 44*a*, 44*b*, and intermediate wheels 50*a*, 50*b*, are mounted on the side of dial 12 of moon phase disc 18. In such case, sun pinion 36 is also mounted in plate 22, on the dial side of disc 18. This assembly enables a large part of the planetary wheel formed by wheels 44, intermediate wheels 50 and pinion 36, to be seen through aperture 16, which may have an interesting and fun effect. In a variant, those skilled in the art could choose to mount the planetary train on the plate 22 side of disc 18, so that only discs 48*a*, 48*b*, to which images of the moon are affixed, appear on the dial 12 side. This embodiment is much more conventional in appearance and is particularly well suited to the embodiment with polarizer-glass plates.

What is claimed is:

1. A timepiece including:

a dial with an aperture;

a moon phase disc mounted behind the aperture;

a moon phase train rotationally driving the moon phase disc;

a fixed sun pinion; and two planetary wheels, each of which is rigidly locked with a representation of the moon;

wherein the moon phase disc is mounted so as to move in rotation about the fixed sun pinion, and wherein the two planetary wheels are rotatably mounted on the moon phase disc and engaging at least indirectly with the sun pinion, so as to form a planetary gearing with the sun pinion.

2. The timepiece according to claim 1, wherein two intermediate wheels are mounted on said moon phase disc, in between said planetary wheels and said sun pinion.

3. The timepiece according to claim 1, wherein said planetary wheels and said sun pinion are toothed, the planetary wheels and the sun pinion having equal number of teeth.

4. The timepiece according to claim 1, wherein said representations of the moon are formed by orbiting discs to which images of the moon are affixed.

5. The timepiece according to claim 1, wherein said moon phase disc is mounted on a plate via a lunation bridge.

6. The timepiece according to claim 5, wherein said lunation bridge is formed of a bar having a first end and a second end, wherein the bar is secured to said plate both at the first end and at the second end.

7. The timepiece according to claim 6, wherein said bar includes two convex portions.

8. The timepiece according to claim 1, wherein said planetary wheels are mounted on said moon phase disc via two planetary bridges.

9. The timepiece according to claim 3, wherein said aperture is circular and sealed by a polarized window including a bottom half and a top half side by side and complementary, and polarized perpendicular to each other, and wherein said representations of the moon are formed by orbiting discs polarized parallel to the polarization of said bottom half of the polarized window.

10. The timepiece according to claim 2, wherein said planetary wheels and said intermediate wheels are mounted on the dial side of said moon phase disc.

11. The timepiece according to claim 2, wherein said planetary wheels and said sun pinion are toothed, the planetary wheels and the sun pinion having equal number of teeth.

12. The timepiece according to claim 3, wherein said representations of the moon are formed by orbiting discs to which images of the moon are affixed.

13. The timepiece according to claim 3, wherein said moon phase disc is mounted on a plate via a lunation bridge.

14. The timepiece according to claim 3, wherein said planetary wheels are mounted on said moon phase disc via two planetary bridges.

15. The timepiece according to claim 3, wherein said planetary wheels and said intermediate wheels are mounted on the dial side of said moon phase disc.

16. The timepiece according to claim 9, wherein said planetary wheels and said intermediate wheels are mounted on the dial side of said moon phase disc.

* * * * *